US008662333B2

(12) United States Patent
Orgeldinger

(10) Patent No.: US 8,662,333 B2
(45) Date of Patent: Mar. 4, 2014

(54) BOX HAVING FOLDABLE SIDEWALLS WITH A STABLE SIDEWALL STRUCTURE

(75) Inventor: Wolfgang Orgeldinger, Munich (DE)

(73) Assignee: IFCO Systems GmbH, Pullach (DE)

( * ) Notice: Subject to any disclaimer, the term of this patent is extended or adjusted under 35 U.S.C. 154(b) by 0 days.

(21) Appl. No.: 13/273,616

(22) Filed: Oct. 14, 2011

(65) Prior Publication Data

US 2012/0118883 A1 May 17, 2012

Related U.S. Application Data

(63) Continuation of application No. PCT/EP2010/054897, filed on Apr. 14, 2010.

(30) Foreign Application Priority Data

Apr. 15, 2009 (WO) ..... PCT/EP2009/002760
Jul. 23, 2009 (DE) ..... 10 2009 034 452
Oct. 13, 2009 (DE) ..... 10 2009 049 185

(51) Int. Cl.
*B65D 6/00* (2006.01)
*B65D 8/14* (2006.01)
*B65D 90/02* (2006.01)

(52) U.S. Cl.
USPC ..... 220/6; 220/669

(58) Field of Classification Search
USPC ..... 220/4.28, 6, 7, 669
See application file for complete search history.

(56) References Cited

U.S. PATENT DOCUMENTS

| | | | |
|---|---|---|---|
| 4,081,099 | A | 3/1978 | Shead |
| 5,398,834 | A | 3/1995 | Umiker |
| 5,829,617 | A | 11/1998 | Umiker |
| 5,967,356 | A | 10/1999 | Laarhoven et al. |
| 6,015,056 | A | 1/2000 | Overholt et al. |
| 6,290,081 | B1 | 9/2001 | Merey |
| 6,386,388 | B1 | 5/2002 | Overholt |
| 6,460,717 | B1 | 10/2002 | Smyers et al. |
| 7,011,225 | B2 | 3/2006 | Oster et al. |
| 7,017,766 | B2 | 3/2006 | Hsu et al. |
| 7,100,786 | B2 | 9/2006 | Smyers |
| 7,159,730 | B2 | 1/2007 | Rumpel |
| 7,861,878 | B2 | 1/2011 | Escarpa |
| 2002/0108950 | A1 | 8/2002 | Moorman et al. |
| 2003/0116564 | A1 | 6/2003 | Overholt et al. |
| 2003/0146213 | A1 | 8/2003 | Kellerer et al. |
| 2004/0099662 | A1 | 5/2004 | Overholt |
| 2004/0129700 | A1 | 7/2004 | Oster et al. |
| 2004/0178197 | A1 | 9/2004 | Hsu et al. |

(Continued)

FOREIGN PATENT DOCUMENTS

| | | |
|---|---|---|
| AT | 009832 | 1/2007 |
| CN | 1730353 | 2/2006 |

(Continued)

*Primary Examiner* — Jeffrey Allen
(74) *Attorney, Agent, or Firm* — Michael A. Glenn; Perkins Coie LLP

(57) ABSTRACT

A foldable box having four foldable exterior walls has at least one stable exterior wall having at least a first and a second spherical wall area convex with respect to an exterior side of the box. A bridge arranged at the outside of the exterior wall is arranged between the first and the second spherical surface and extends across the height of the exterior wall. At least one rib additionally extends from the bridge to the first and to the second spherical surface area.

8 Claims, 14 Drawing Sheets

(56) References Cited

U.S. PATENT DOCUMENTS

| | | | | |
|---|---|---|---|---|
| 2004/0226945 | A1 | 11/2004 | Hsu et al. | |
| 2006/0231555 | A1* | 10/2006 | Smyers et al. | 220/6 |
| 2007/0145053 | A1 | 6/2007 | Gil | |
| 2008/0169285 | A1 | 7/2008 | Marazita et al. | |
| 2008/0302791 | A1* | 12/2008 | Baltz | 220/7 |
| 2011/0259884 | A1 | 10/2011 | Kellerer et al. | |
| 2011/0272400 | A1 | 11/2011 | Huizingh | |

FOREIGN PATENT DOCUMENTS

| | | | |
|---|---|---|---|
| DE | 19623690 | A1 | 6/1996 |
| DE | 10137328 | B4 | 7/2001 |
| DE | 20210106 | | 6/2002 |
| DE | 202004016511 | | 10/2004 |
| EP | 1114779 | A2 | 7/2001 |
| EP | 1647492 | A1 | 4/2006 |
| EP | 1655232 | | 5/2006 |
| EP | 1655232 | A1 | 5/2006 |
| EP | 1840038 | | 10/2007 |
| EP | 2036825 | | 3/2009 |
| ES | 2285290 | | 11/2007 |
| FR | 2408979 | | 6/1979 |
| GB | 2425303 | B | 4/2006 |
| GB | 2452750 | A | 9/2007 |
| GB | 2443949 | | 5/2008 |
| JP | H-10506868 | | 7/1998 |
| JP | 11505790 | | 5/1999 |
| JP | 2002362549 | | 12/2002 |
| JP | 2003518471 | | 6/2003 |
| JP | 2003312659 | | 11/2003 |
| JP | 2004018004 | | 1/2004 |
| JP | 2004262540 | | 9/2004 |
| JP | 2004323095 | | 11/2004 |
| JP | 2005022667 | | 1/2005 |
| JP | 2007168822 | | 7/2005 |
| JP | 2005231723 | | 9/2005 |
| JP | 2007168821 | | 7/2007 |
| JP | 2007176562 | | 7/2007 |
| JP | 2007217002 | | 8/2007 |
| JP | 2009029484 | | 2/2009 |
| JP | 2009255932 | | 11/2009 |
| WO | WO-96/11144 | | 4/1996 |
| WO | WO-9637410 | | 11/1996 |
| WO | WO-98/34838 | | 8/1998 |
| WO | WO-00/63084 | | 10/2000 |
| WO | WO-00/68101 | | 11/2000 |
| WO | WO-0147778 | | 7/2001 |
| WO | WO 03053799 | | 7/2003 |
| WO | WO-2005016770 | | 2/2005 |

* cited by examiner

BOX HAVING FOLDABLE SIDEWALLS WITH A STABLE SIDEWALL STRUCTURE

CROSS-REFERENCE TO RELATED APPLICATIONS

This application is a continuation of copending International Application No. PCT/EP2010/054897, filed Apr. 14, 2010, which is incorporated herein by reference in its entirety, and additionally claims priority from International Application No. PCT/EP2009/002760, filed Apr. 15, 2009, and German Applications Nos. DE 102009034452.7, filed Jul. 23, 2009 and DE 102009049185.6, filed Oct. 13, 2009, all of which are incorporated herein by reference in their entirety.

BACKGROUND OF THE INVENTION

The present invention relates to easily transportable boxes whose side walls may be folded down for transport and whose side walls comprise a special, highly stable structure which is still flat and light.

On the market place, a plurality of foldable boxes or foldable crates is available consisting of a bottom or floor and side walls which are foldable with respect to the floor so that the boxes may be folded after use by folding down their side walls in order for them to be transportable back to the location of their renewed use in a space saving and cost effective way.

As such foldable boxes may be used industrially on a large scale and for many different purposes, for example to transport fruit or vegetables from the harvest fields to the consumers, such a foldable box has to fulfill many different requirements which partially influence each other. With respect to cleaning, it is especially desirable that at least some of the exterior walls stand on their own in the up-folded state, i.e., remain in the up-folded state, as it is needed for successful and thorough cleaning that the complete interior volume of the box is easily accessible.

Especially high requirements are also directed to the stability of the boxes as the same, for example when transporting fruit and vegetables, are loaded directly at the field by field workers and the vegetables remain within the same box during the complete transport to the end consumer, i.e., the box has to survive the many loading and unloading processes during transport, if possible without getting damaged. Further, the boxes are also used several times according to their purpose which even increases requirements regarding robustness. On the one hand, it is of course very desirable that when keeping side conditions of a weight which is as low as possible, the walls and the floor of the foldable boxes are as robust as possible. Further, due to the plurality of handling processes and actions needed during the transport of such a box, it is to be ensured that normal operation is as easy as possible. It is to be guaranteed simultaneously that in case of erroneous use or operation, the used mechanical components are not destructed. In particular, foldable boxes comprise a locking mechanism by means of which the erected walls are interlocked with each other so that the up-folded box receives the needed stability. This locking mechanism should be operable as easily as possible and error-free without much force. However, additionally, the possibility of a wrong operation should be considered, i.e., that a force acts upon the locking mechanism without the same being operated. In this case, the locking mechanism should be destroyed by no means.

A further requirement to such foldable boxes should be that the hinge mechanism which produces a foldable connection between the door and the exterior walls of the foldable box may absorb large forces. The same presents, in the up-folded state, the only non-positive connection between the floor on which usually the complete load is arranged and the exterior walls at which the grip holes are usually located. Even if a robust implementation of a box is used, a destruction of individual components of the box, i.e., in particular of the floor or one of the side walls, may not be excluded in every day use. It is thus desirable that the side walls may easily be detached from the floor without the capability of carrying a high load suffering from the ease of dismantling the non-positive connection.

Some requirements here result from the aspect of transportability. Thus, it is a especially desirable for the box to have only a low stacking height in the down-folded state so that on a pallet during transport a number of down-folded boxes may be transported which is as high as possible. Further, the box ought to be as light as possible, i.e., as little material as possible ought to be used to keep the ratio of the loading capacity or useful load to the weight of the box as low as possible. Apart from this, such boxes are frequently used for the transport of food and it is needed for the interior side of the box to be as smooth or flat as possible so that no food rests will get trapped in the interior of the box. Simultaneously, the box ought to be stable, which makes the use of large flat planes difficult. Further, easy cleaning of the boxes is to be guaranteed which, on the one hand, needs flat surfaces and, on the other hand, the possibility has to be given that in automated washing systems cleaning agents or water used during cleaning may run off from the box. This requests drain holes or perforations which are, again, in contradiction to the requested high stability.

SUMMARY

According to one embodiment, a foldable box may have four foldable exterior walls, wherein at least one of the exterior walls may have at least a first and a second spherical wall area convex with respect to an exterior side of the box, which are adjacent to each other in a horizontal direction; and a bridge arranged between the first and the second spherical surface extending across the height of the exterior wall and arranged at the exterior side of the exterior wall; at least one rib extending from the bridge to the first spherical surface area and to the second spherical surface area.

According to some embodiments of the present invention, at least one of the exterior walls comprises a particularly stable structure having advantageous characteristics which is produced by the fact that per se stable, spherical wall areas convex with respect to an exterior side of the box are connected by means of an arrangement of bridges and ribs. By this, an extremely thin and stable exterior wall is provided which is stable and yet lightweight. According to some embodiments, between two spherical wall areas of the exterior wall convex with respect to the exterior side, a bridge arranged at the outside of the exterior wall extending across a height of the exterior wall is arranged . Additionally, one or a plurality of ribs passes between the spherical wall areas, wherein the ribs extend from the bridge up to each one of the spherical surface areas on both sides of the bridge. These embodiments of inventive exterior walls thus include spherical surfaces arranged adjacent to each other and connected to each other by means of an arrangement of ribs and bridges between the respectively adjacent spherical surfaces in order to increase the rigidity of coupling of the exterior wall.

The spherical surfaces have the advantage that the same are intrinsically torsion resistant up to a certain size which is caused by the curvature of the surface at its edge areas. In this respect, spherical surfaces are regarded as surfaces which rise from a plane base surface into a predetermined direction, wherein the surface does not stand out in a staircase shape from the base surface regarding the contour, but the contour goes away from the base surface in an s shape with predetermined radii. After the elevation or rise, a spherical surface area may also comprise a partial surface which is completely plane and passes in parallel to the base surface in a distance which depends on the s shaped contour at the edge of the spherical surface. If the plane or level surface within the spherical surface becomes too large, this surface, again, becomes instable, so that there are restrictions with respect to the size of an intrinsically stable spherical surface. The use of an individual spherical surface as a side wall, with extensive side walls, would thus not have a large effect supporting stability. Spherical surfaces have the advantage, however, that same are flat on both sides, comprise no edges or cracks so that same are very suitable for the transport of food, as the danger of food being caught in edges or like is not given.

With some embodiments of the present invention, several convex surface areas in a wall are used which are interconnected by an arrangement of ribs and bridges perpendicular to the ribs extending across the height of the exterior wall to connect the per se stable convex surface areas without high material expense in a very torsion resistant way, so that an all-in-all very robust structure with a low wall strength results. In some embodiments of the present invention, the bridges and the ribs are exclusively arranged on the outside of the exterior wall so that the stiffening effects are achieved without hygiene suffering by food getting caught in the sharp edges of the ribs and bridges in the interior of the box. In some embodiments of the present invention, any hinge arrangements connecting the exterior wall to the floor of the foldable box are basically arranged in areas in which the bridges are located between the spherical surfaces. As the bridges extending across the height of the exterior wall are those structures which may carry the greatest tensile stress, by the produced arrangement of the hinge elements a structure or an exterior wall is generated comprising the highest possible stability requirements also regarding power transmission or force transmission to the floor and it simultaneously only needs a thin material-saving exterior wall which is flat or smooth at the interior side and thus easy to clean.

With some embodiments of the present invention, the easy dismantling of an exterior wall from the floor of a foldable box is achieved by using a special hinge arrangement including both a shaft arranged at the floor of the exterior wall and also a cam arranged there so that only when up-folding the exterior wall a non-positive connection between the floor and the exterior wall is produced. In order to enable this, in some embodiments in the floor or in an exterior wall area which is fixed and extends from the floor in a vertical direction upwards (i.e., in the direction of the up-folded side wall), wherein the exterior wall area may also be manufactured integrally within the floor, a recess is located within which the shaft is located. Further, on the floor, a contact surface is arranged which is a surface arranged with respect to the floor in a known relative orientation. The cam, as will be explained in more detail with respect to some of the following figures, is implemented as or comprises such a three-dimensional contour that the cam, which is rigidly connected to the exterior wall when up-folding the cam wall, gets in contact with the contact surface, i.e., gets in contact with the same and is supported by the same. This support causes a translational movement of the shaft which is also rigidly connected to the exterior wall. The guide hole or opening is geometrically implemented so that the same comprises an opening section passing basically in a vertical direction (i.e., basically perpendicular to the surface of the floor) and a lateral opening section virtually perpendicular to the same passing in the lateral direction from the outside to the inside. Both the opening section and also the lateral opening section comprise a cross-section which is large enough to move the shaft in the two sections. In the down-folded state of the exterior wall the shaft is first of all arranged on the floor of the opening section of the guide opening and may be removed through the opening section in the vertical direction upwards. Thus, the shaft is not in the way of dismantling the exterior wall in the down-folded state.

Producing a non-positive connection is only executed when up-folding the exterior wall. During up-folding, the contour of the cam is in contact with the contact surface which guides or supports the cam. Due to the rigid connection of the cam and the shaft via the exterior wall and guiding the cam at the contact surface it is achieved that the shaft moves into the lateral opening area in the guide opening, wherein the opening area is closed upwards at least in one place, i.e., is limited in the upward direction for example by the material of the exterior wall or the fixed exterior wall area. If the shaft is thus located in the lateral opening section, the same may not be removed from the top and a configuration resulted which produces a connection between the exterior wall and the floor in the vertical direction so that the same may absorb a force or withstand a weight load. In other words, guided by the cam which is supported at the contact surface, by the shaft a swing or translational movement is executed which moves the shaft from a initial position in the lateral opening section into an end position in the lateral opening section, so that when up-folding the wall a stable connection between the exterior wall and the floor results, while in the down-folded state the shaft may be removed from the top of the guide opening and thus the wall may be dismantled.

With some embodiments, in the floor or in the fixed exterior wall area extending upwards from the floor, a further recess is located within which the cam is located. In this cam opening the support surface is arranged. In some embodiments, the support surface is formed by the exterior side wall or boundary surface of the cam opening.

In some further embodiments of the invention, the carrying capacity or stability of the resulting connection is additionally increased by the fact that the cam opening also comprises an opening section passing in the vertical direction and a lateral opening section passing in the lateral direction, wherein the cam has an exterior contour or is geometrically implemented so that in the up-folded state an element of the cam or a recess in the cam engages the lateral opening section of the cam opening during up-folding. By this, the cam is also prevented from sliding upwards out of the cam opening with a tensile stress, by the massive material of the floor located above the lateral opening section of the cam opening. Thus, the cam in the cam opening in the up-folded state may also additionally receive weight or carry an additional load which increases the stability or strength of the foldable box in this embodiment. Here, in some further embodiments of the present invention, the cam opening comprises such a cross-section in the vertical direction that the cam in the down-folded state of the side wall may be removed upwards from the cam opening so that also in the embodiment in which the cam may carry additional load, the exterior wall may be dismantled in the down folded state without any tools. In some embodiments, the geometry is selected such that both the cam opening and also the guide opening extend in the lateral direction outwards up to a common exterior wall so that the same in other words comprise identical dimensions in the lateral direction. In the direction perpendicular to the vertical and the lateral direction, the cam opening or the guide opening in some embodiments comprise dimensions which are slightly larger than the horizontal extension of the shaft or the horizontal extension of the cam in order to enable a connection free of play also in this dimension between the exterior wall and the floor or the fixed exterior wall area of the floor. In other words, the horizontal extension of the guide opening and the cam opening basically corresponds to the horizontal dimensions of the shaft or the cam, wherein the horizontal extension of the openings is slightly larger, for example by 0.5 mm or by 1 mm.

By the use of the above-mentioned hinge arrangement or by the use of a foldable box according to one of the above-described embodiments, it is possible to provide a foldable box whose exterior walls may be completely folded down and in the down-folded state may easily be removed—for example being exchanged by a spare part or for cleaning—from the foldable box—wherein the connection between the exterior wall and the floor or the fixed exterior wall area of the floor is still able to absorb a high force as it is conventionally only the case with conventional hinges which may not be dismantled.

According to some further embodiments of the invention, a foldable box is provided which comprises exterior walls which are held in the up-folded state after folding up the same, wherein an automatic down-folding of the exterior wall is also prevented. Some embodiments of the invention are based on the above described hinge arrangement comprising a shaft in a guide opening, without the guide opening necessarily having to comprise an opening area suitable for being removed in the vertical direction. It is only needed that the guide opening comprises the lateral opening section extending in the lateral direction from the outside of the fixed exterior wall area inwards, wherein the shaft may be shifted within the opening section. Here, further use of a cam is needed which is arranged in the base section of the exterior wall, wherein the cam comprises a cam contour which is implemented such that when raising up or erecting, by a contact of the cam contour to the contact surface, already when exceeding a boundary angle, the shaft is moved into the lateral opening section inwards before the side wall is completely erected.

In some embodiments, the contour of the cam is implemented such that the boundary angle, when erecting the exterior wall, is exceeded before the underside of the exterior wall, when erecting, will get in contact with the interior edge area of the fixed exterior wall area of the floor extending upwards. By the fact that the shaft, at the first contact of the floor of the exterior wall with internal edge area, is already located at the internal position in the lateral opening section, the shaft may absorb a force basically directed upwards.

As the shaft may already absorb this force, when further erecting the exterior wall, across the internal edge area, by the effect of the shaft rigidly connected to the exterior wall (for example via a spacer attached to the base of the interior wall), the underside of the exterior wall is pressed with a first pressing force against the internal edge area of the fixed exterior wall area. The same is larger than the second contact pressing force using which the underside of the exterior wall in the upraised vertical position, i.e., after exceeding the internal edge area, is pressed against the upper side of the fixed exterior wall area by the shaft.

In other words, moving the shaft inwards in the lateral opening section (to the internal end position) before the exterior wall gets into contact with the internal edge area will cause a force threshold to be exceeded when rising up or erecting the exterior wall. This threshold force acting onto the underside of the exterior wall after exceeding the boundary angle by the effect of the shaft, is the greatest force which acts during erecting between the underside of the exterior wall and the fixed exterior wall area of the floor. Thus, after exceeding this force, i.e., after completely erecting the exterior wall, the exterior wall is held in the upright position as the force acting in the upright position between the underside of the exterior wall and the fixed exterior wall area is smaller and the exterior wall may thus not overcome the internal edge area by simply folding down by the weight force of the exterior wall without external force.

The above described embodiments of the invention thus enable to provide a foldable box in which the exterior walls, after erecting, may not fold back automatically into the down-folded state, even if the exterior walls of the foldable box are not snapped or latched into each other in the upright state.

This may be a substantial advantage in the fully automated cleaning of the foldable boxes, which has to be repeated manually, when for example due to a wrong operation when latching the exterior walls are able to automatically fold inwards again. Also when conventionally folding up the exterior walls, a self-standing exterior wall may be a great advantage as the same, first of all, may be put up so that the remaining walls may be raised afterwards and latched or interlocked with the already up-folded walls without it having to be insured manually that the already up-folded wall stays up. Regarding the plurality of handling processes occurring in a life cycle of such a foldable box, this is a substantial advantage regarding efficiency and costs.

In particular, also the functionality that the exterior wall in the up-folded state stays up automatically may be achieved without clamps at moving parts which are conventional in standard technology like, for example, at the shafts of the hinges having to be provided through which otherwise a limitation of the movement of a hinge is achieved. Such clamps, in particular when using plastics parts, are subject to wear and tear, so that the inhibition of movement and thus the functionality of the side wall is automatically reduced over time. In the inventive embodiments the mechanism, however, it is basically free of wear as the movement of the shaft itself is completely free of wear within the lateral opening section. The force is generated without friction by an elastic tracking of the participating components so that with a correct dimensioning of the component absorbing the force, for example the bridge or spacer connecting the shaft to the exterior wall, a wear and tear free continuous functioning is guaranteed.

According to some further embodiments of the present invention, a foldable box is provided comprising two respectively opposing pairs of longitudinal and transverse side exterior walls arranged foldable with respect to the floor of the box and enabling folding down the exterior walls inwards. In the up-folded state, the four exterior walls are connected to each other mechanically or are latched in order to obtain a foldable box comprising a high stability.

To enable latching, each of the longitudinal side exterior walls comprises a protrusion at each end extending in the direction of the transverse side exterior walls in the up-folded state, wherein the protrusion restricts foldability of the transverse side exterior walls to the outside, i.e., has the effect of a stop. By the term longitudinal side, the impression is not to be given that the actually longer exterior wall has to comprise this protrusion in any embodiment. In some alternative embodiments, it is the shorter exterior walls referred to as the transverse side which comprises this protrusion so that the terms longitudinal side and transverse side may be exchanged randomly. Any of the transverse side exterior walls comprises spring-pretensioned latching mechanisms arranged at the exterior side of the transverse side exterior wall, which comprise, in the up-folded state, a snap-in or latching or locking element moveable in a vertical direction which may be latched with the protrusion of the longitudinal side exterior wall.

The snap-in element may thus snap directly into the protrusion or into an object connected to the protrusion or may latch with the same. By the vertical movement of the snap-in element it is achieved that the snap-in element may be moved virtually without force, i.e., when opening the snap-in element or the latching only the spring force of the spring of the spring pre-tensioned latching mechanism has to be overcome in order to thus be able to release the latch in a simple way in normal operation. By this, the transverse side exterior wall is separated from the longitudinal side exterior wall so that the same may be folded down. Snapping in and out in a vertical direction has the advantage with respect to conventional solutions in which snapping in or out is executed in a lateral folding direction or in a horizontal direction and locking or unlocking takes place in one direction in which the connection between the side walls does not have to absorb a force, so that no high force has to be used in order to lock or unlock the snap-in element. With locking methods in which locking or latching takes place in one direction into which the exterior wall is moved by opening or closing, it is definitely needed in normal locking or unlocking to overcome the high closing or clamp force of the lock in order to achieve a unlocking. This leads to losses regarding speed and reliability of handling which may be prevented by vertical locking mechanisms.

According to the embodiments of the locking mechanisms described in the following, the protrusion and/or the snap-in element in the up-folded state additionally comprises, with respect to the vertical direction, contact surfaces which are inclined such that the locking mechanism opens against its spring preload when exceeding a predetermined force directed inwards acting upon the transverse side exterior wall. The flanks or edges of the locking tabs or catches or the protrusion where the snap-in element and the locking tab of the protrusion or the protrusion itself slide along each other are inclined with respect to each other so that depending on the inclination, when force acts from the outside of the foldable box onto the transverse side exterior wall, also a force component acts in the vertical direction, i.e., against the spring preload onto the snap-in element. Thus, so to speak, an emergency release may be achieved when, for example by a wrong operation a high force acts on the transverse side exterior wall. Thus, the locking mechanism is not destroyed which would lead to a replacement of the box or a side wall.

By the inclination of the snap-in element with respect to the protrusion or a locking hook attached to the protrusion, the predetermined force where the emergency release occurs or where the locking mechanism opens against spring pretension may be sat randomly over a wide range. Here, in contrast to conventional methods the size of the predetermined force, at which the locking automatically opens, has no influence on the force to be exerted, which is needed when the locking mechanism is in normal operation, i.e., occurs by manually operating the snap-in element in the vertical direction. The embodiments of the present invention thus enable both, a comfortable and regular operation and an additional securing against wrong operation without the parameters of one of the two operating methods—the regular one and the wrong operation—being dependent on each other. Thus, embodiments of the inventive foldable boxes may even be manufactured so robust that the latching in continuous operation may not only be opened by a conventional manual operation of the snap-in elements but also by hitting or stepping onto the transverse side exterior wall without damage of the box or the snap-in mechanism occurring.

BRIEF DESCRIPTION OF THE DRAWINGS

In the following, some embodiments of the present invention will be explained in more detail with reference to the accompanying drawings, in which.

DETAILED DESCRIPTION OF THE INVENTION

Figure 1:
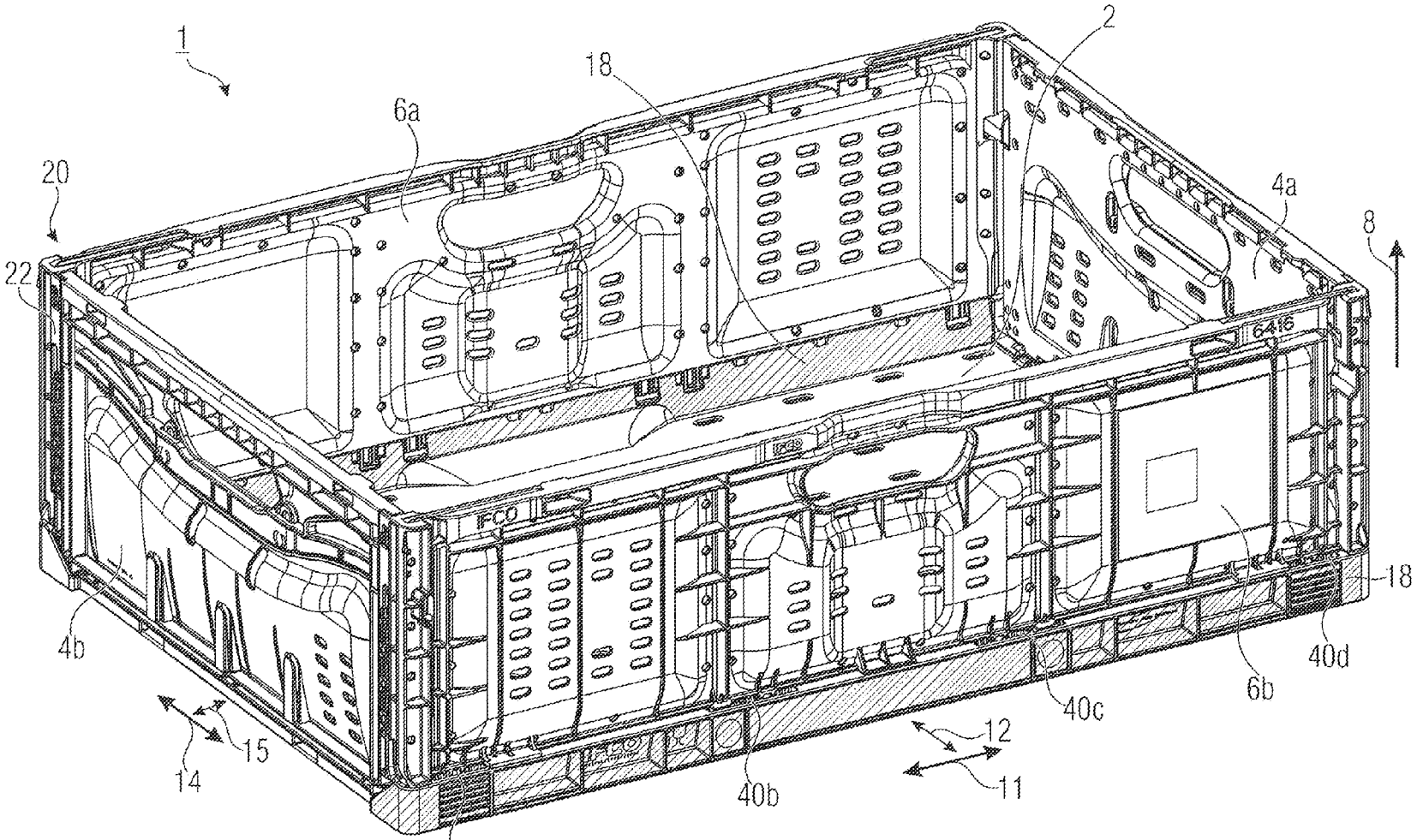
FIG. 1 shows an overall view of an embodiment of a foldable box.

FIG. 1 shows a semi-perspective view of an embodiment of a foldable box. Here, a foldable box within the scope of this description is a box or a crate which is open in one direction (in the vertical direction to the top) and which comprises a floor and four exterior or side walls which are connected to the floor such that they may be moved or up-folded or down-folded with respect to the floor. In the down-folded state, i.e., when all four walls are folded onto the floor, the box only has a low building height and is easily transportable.

The foldable box of FIG. 1 thus comprises a floor, pairs of opposing transverse side exterior walls 4*a* and 4*b* and pairs of opposing longitudinal side exterior walls 6*a* and 6*b*. It is to be noted here, that for identifying the exterior walls in the following description the exterior walls are to be designated as longitudinal side exterior walls which have a larger extension than the transverse side exterior walls. This is not to be regarded as restrictive insofar as those features described in connection with the longitudinal side exterior walls are implemented in all embodiments of the invention only at the longer side walls. Rather, the term longitudinal side and transverse side only serve for the identification of the respectively described exterior walls. In other words, the terms longitudinal side and transverse side may also be exchanged so that the features described for the longitudinal side exterior walls may also be implemented at the transverse side and of course also at both side walls (simultaneously). In general it applies that any features described in the following may randomly be combined with each other so that some embodiments of inventive foldable boxes only comprise one of the features while other embodiments may comprise all features.

As already mentioned above, FIG. 1 shows a foldable box in the up-folded state while the box is to be regarded as being in the down-folded state when all side walls are folded down. For simplifying the description of the individual features, certain directions or geometrical relationships for the following description are defined as follows. The vertical direction 8 basically passes perpendicular to the surface of the floor 2, wherein the relative position designations top and bottom in this connection are to be regarded such that top designates a position further spaced apart from the floor in the vertical direction than bottom. The relative position indication internal or inside designates a position which is closer to the volume enclosed by the box than a position which is designated by the term exterior or outside. Outside or exterior, for example means, with respect to the longitudinal side exterior wall 6*b*, that those components are described with are directly visible in the semi-perspective view of FIG. 1. The height of the side walls is the extension in the up-folded state illustrated in FIG. 1 in the vertical direction 8, while thickness or width is the maximum extension between interior side and exterior side of the exterior walls.

The directional information lateral and horizontal respectively refer to the currently regarded exterior wall. The horizontal direction is the direction along the greatest longitudinal extension of the considered side wall, so that the horizontal direction with respect to the exterior wall 6*b*, for example, results as indicated by arrow 11. The lateral direction refers to the direction between the exterior side and the interior side or internal side of the walls in the up-folded state so that, for example, for the exterior wall 6*b* the lateral direction designated by reference number 12 results. The corresponding application of this definition to the transverse side exterior wall 4*b* leads to a horizontal direction 14 and a lateral direction 15. In the up-folded state of the box, thus with respect to each exterior wall, the lateral, the vertical and the horizontal direction define a basic rectangular coordinate system. Apart from this, when doubts of interpretation result with respect to position or orientation information, the information is to be regarded as relating to the box in the up-folded state illustrated in FIG. 1.

As it may be seen with respect to FIG. 1, some embodiments of the present invention comprise a floor 2, on the one hand consisting of a level, plane main part and comprising a fixed exterior wall area 18 extending from the floor in a vertical direction upwards at two opposing exterior sides. For a better illustration, the same is illustrated in a hatched way in FIG. 1 and may, for example, serve to receive or provide hinge elements and to ensure that a pair of side walls in the down-folded state comes to rest on the other pair of side walls. In the discussion of the following elements, the fixed exterior wall area extending upwards in the vertical direction is regarded as belonging to the floor, so that some of the discussed features may also be realized in the level floor area.

Figure 2:
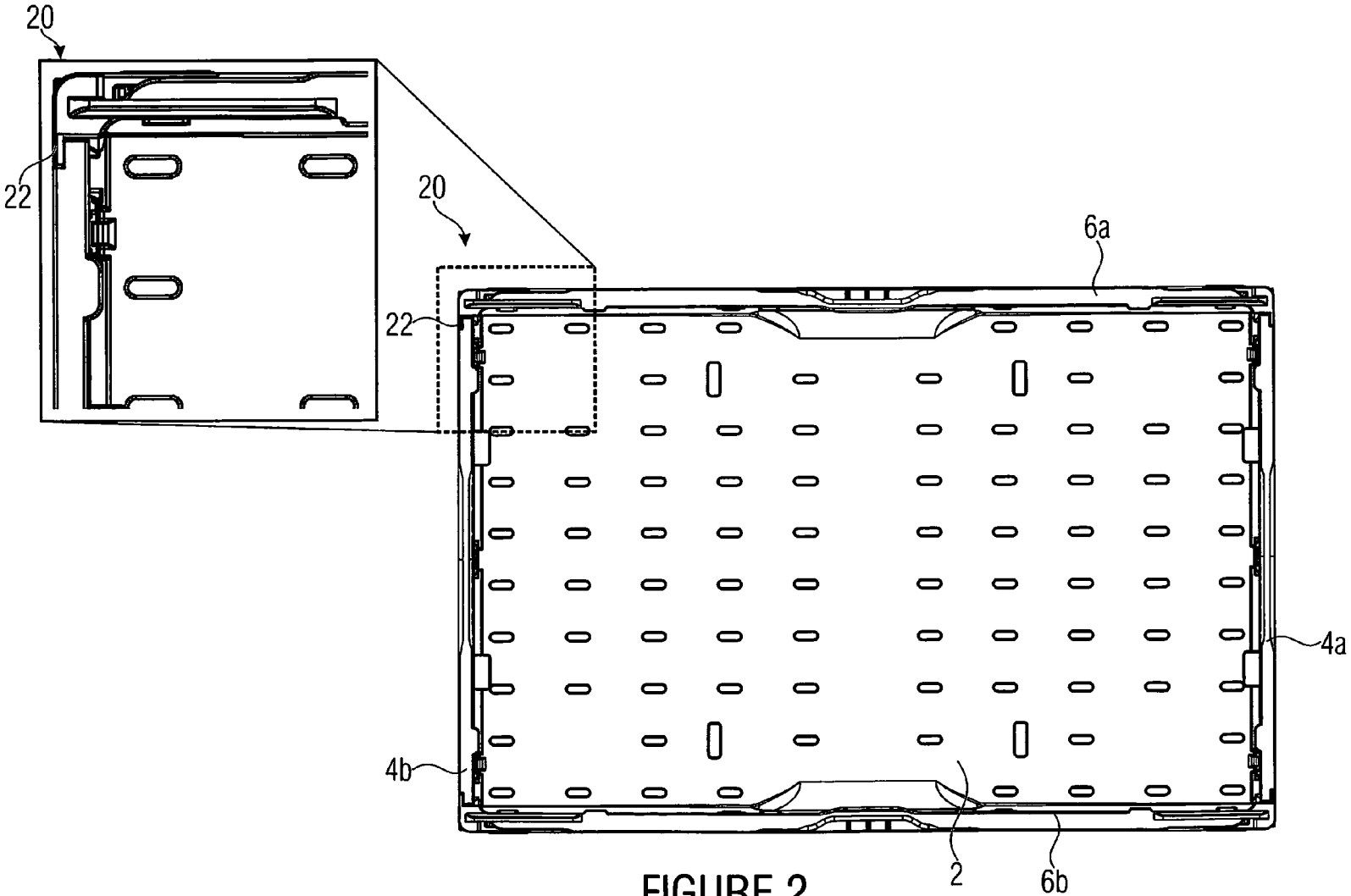
FIG. 2 is a top view onto the embodiment of the box of FIG. 1.

FIG. 2 shows for a renewed illustration a top view onto the foldable box illustrated in FIG. 1 in which the floor 2, the longitudinal side exterior walls 6*a* and 6*b* and the transverse side exterior walls 4*a* and 4*b* are well visible. Further, it may at least be gathered in FIG. 2 that the longitudinal side and the transverse side exterior walls, in the up-folded state, are latched to each other at the respectively adjacent edges, so that the up-folded box achieves a high stability. As only indicated here and discussed in more detail in some of the following paragraphs, for locking or for latching the longitudinal side exterior walls comprise a protrusion extending in the direction of the transverse side exterior wall 4*a* which limits the foldability of the transverse side exterior wall 4*a* to the outside, that is in an up-folding direction, and thus so to speak acts as a stop. This mechanism is discussed in the following with reference to the corner 20 of the longitudinal side exterior wall 6*a*. When locking, a snap-in element arranged at the transverse side exterior wall 4*a* engages the protrusion 22 and latches with the same to form a mechanically durable or resistant connection in order to achieve the stability of the box.

Figure 3:
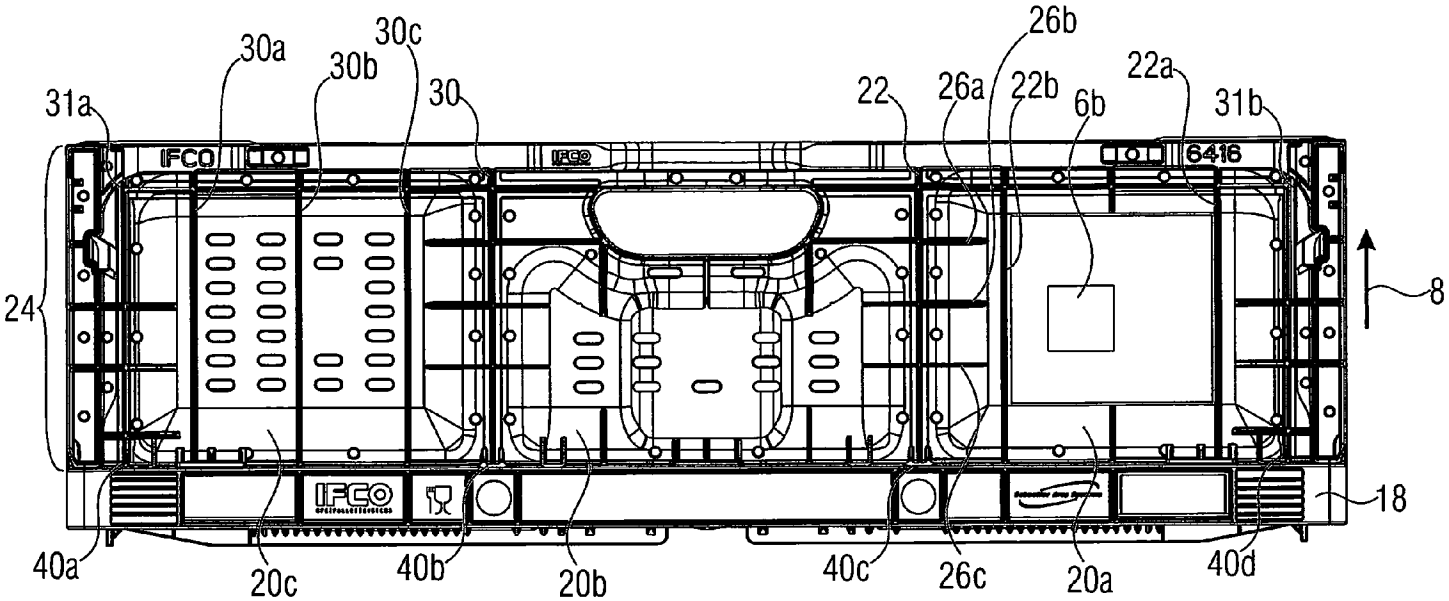
FIG. 3 is a side view of the foldable box of FIG. 1.

FIG. 3 shows a side view of an embodiment of a foldable box in which some advantageous features of the exterior wall 6*b* of this embodiment are well visible. The implementation illustrated in FIG. 3 of the exterior wall 6*b* distinguishes itself by the fact that spherical surface areas which are convex with respect to the exterior side of the foldable box are combined with stiffening elements of ribs and bridges such that an exterior wall results which is as a consequence very stable which, however, is simultaneously basically smooth or flat at its interior side and comprises only a small thickness, that is a small extension in the lateral direction. The thickness in the lateral direction is a criterion not only with respect to the material to be used and the weight, but in particular also for the stacking height to be achieved, i.e. the height of a box in the down-folded state, which basically results from the thickness of the floor, the transverse side exterior walls and the longitudinal side exterior walls. The thinner a wall with the given flexibility is, the better.

This is achieved in the embodiments described here by the exterior wall consisting of spherical wall areas 20*a*, 20*b*, and 20*c* convex with respect to the outer or exterior side, wherein the areas are connected to each other by means of an arrangement of ribs and bridges. Up to a certain size, the spherical wall areas are intrinsically stable due to their shaping, as already indicated above. As illustrated in FIG. 3, between the spherical wall area 20*a* and the spherical wall area 20*b*, a bridge 22 arranged at the exterior side of the exterior wall is provided extending across the height 24 of the exterior wall, i.e. passing in the vertical direction 8. This bridge leads to a high strength in the vertical direction. From the bridge 22, a plurality of horizontally passing ribs 26*a*-26*c* extend up to the spherical surface areas 20*a* and 20*b* adjacent to the bridge 22. By the combination of the intrinsically stiff spherical surface areas with the ribs and bridge arrangements connecting the spherical surface areas comprising at least one bridge and one rib extending from the bridge to the adjacent spherical surfaces, enable to provide a very thin and stable exterior wall using little material. This has the advantage that here the interior side basically has a flat or smooth surface as both the spherical surfaces protrude or bend outwards and also the ribs are attached to the outside, i.e. the available building height is utilized to a maximum efficiency in order to achieve an overall construction as stiff as possible.

The use of bridge and rib arrangements connecting the spherical surface elements additionally enables to punch the spherical surface elements or provide the same with a plurality of perforations to save material and be able to clean the wall thoroughly. The perforation weakening the structure of the spherical surface areas may here be accepted as by the use of bridges and ribs between the spherical surface areas the overall stability may still be maintained. In FIG. 3, further bridges 22*a*, 22*b* and 30*a* to 30*c* are illustrated which extend across the spherical area and serve to further increase the overall stability.

In other words, a further embodiment of the invention only comprises the bridges 22 and 30 between the spherical surface areas 20*a*, 20*b*, 20*c*. For a further increase of the stability of the overall construction, hinge arrangements using which the exterior wall is foldably connected to the floor 2 or to the fixed exterior wall area 18 are only arranged in those areas at the base of the exterior wall 6*b* (at the end of the exterior wall 6*b* facing the floor 2) in which the bridges extend up to the base area of the exterior wall. Any of the hinge arrangements or hinge mechanisms 40*a*, 40*b*, 40*c* and 40*d* which are only indicated briefly here are located, in the embodiment indicated in FIG. 3 and in FIG. 1, in the area of the bridges passing in the vertical direction 8. This leads to an increased stability of the overall construction, as the hinges have to absorb the force acting in the vertical direction 8 when the box is loaded, so that it is a great advantage when the hinges are located at the position of the bridges which also serve to absorb load in the vertical direction.

A bridge which is capable to do this is generally a material protruding from the surface of the exterior wall in the lateral direction which extends beyond the heights of the exterior wall. In an equivalent application of this definition, the ribs also extend in the lateral direction from the surface of the exterior wall, wherein the ribs pass basically along the horizontal orientation. With some other embodiments, the ribs do not pass horizontally but in a different orientation, wherein it is to be guaranteed that at least one rib extends from the bridges, also in a different orientation, up to the spherical surface areas adjacent to the bridges.

Figure 4:
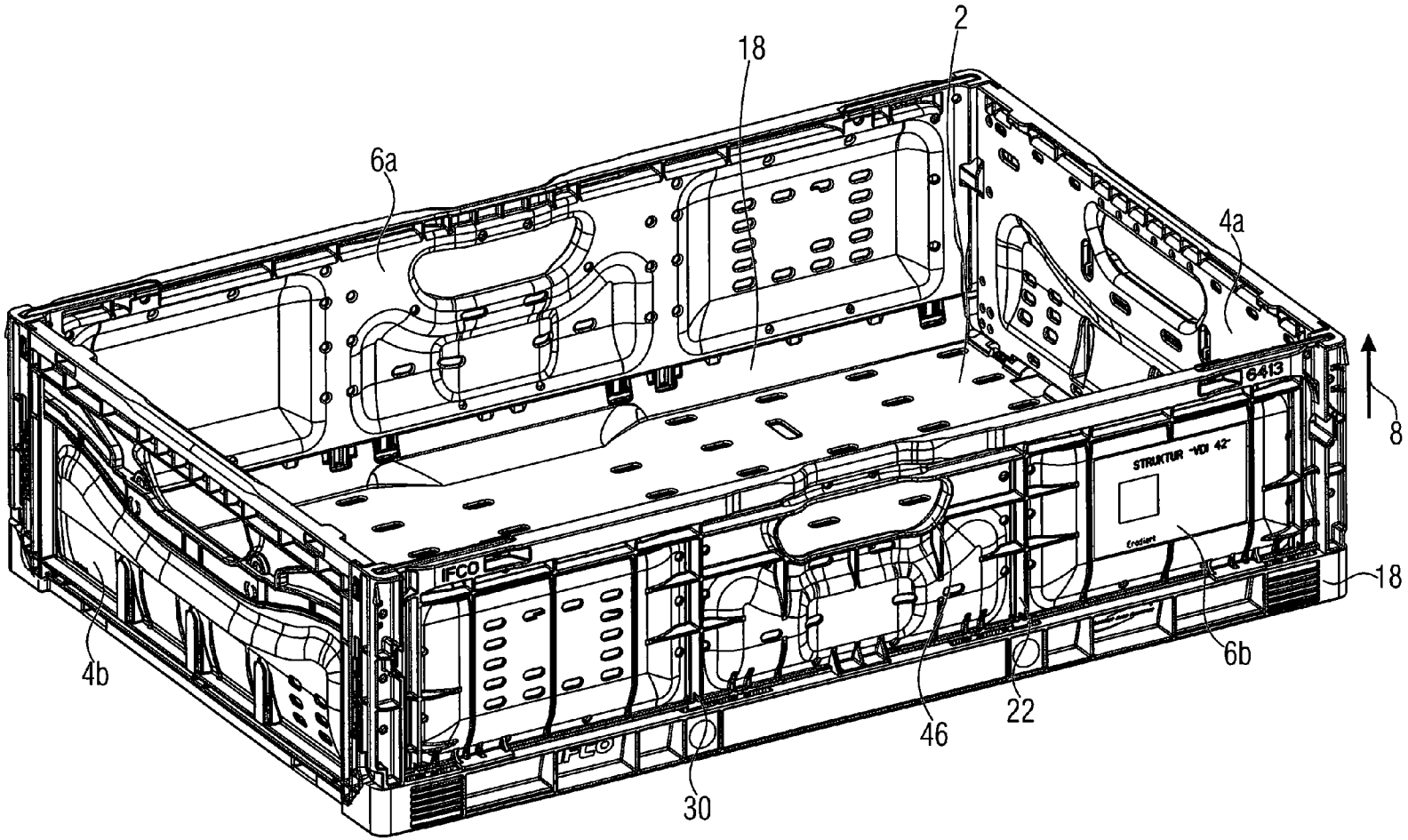
FIG. 4 is an overall view of a further embodiment of a foldable box.

FIG. 4 shows a view of a further embodiment of a foldable box which is different from the embodiment illustrated in FIG. 1 by a different dimensioning. In particular, the foldable box illustrated in FIG. 4 comprises a lower height, i.e. a more restricted extent of the vertical direction 8. As the remaining features of the foldable boxes in FIGS. 1 and 4 are the same, with respect to a description of the features reference is made to what was said regarding FIG. 1, wherein also regarding the more restricted height of the box illustrated in FIG. 4 still the concept of adjacent spherical surface areas may be realized which are connected by means of a bridge and at least one rib extending from the bridge to each of the adjacent spherical surface areas, as it may be gathered from FIG. 4. FIG. 4 thus illustrates the great flexibility of the functional cooperation of the spherical wall areas and the bridge and rib construction connecting the same, which may easily be adapted to different geometrical boundary conditions. In particular, it is also enabled in FIG. 4 (like in FIG. 1) to attach a grip opening 46 in the central area of the foldable box using which conventionally in normal use of the box the complete load is lifted. Here, the use of spherical surface areas enables to construct a spherical surface area excluded by the grip area and located below the grip area, so that also in the area of the grip a spherical surface area increasing stability does not have to be done without. As illustrated in FIG. 4, the grip is connected to the spherical surface area underneath by means of vertically passing bridges which leads to an increase of the stability in the direction of force. Further, an outer contour of the grip is directly connected to the bridges 22 and 30 arranged between the spherical surface areas via additional ribs which leads to the fact that the opening of the grip area 46 which actually weakens the stability of the construction does not affect the overall stability as the force acting on the grip may directly be transmitted to the adjacent spherical surface areas.

Apart from that, in FIG. 4 the functionally identical or similar functional elements or features are provided with the same reference numerals which were already used in FIG. 1. This also applies to the following drawings in which functionally like or functionally similar elements or features are each provided with identical reference numerals.

Figure 5:
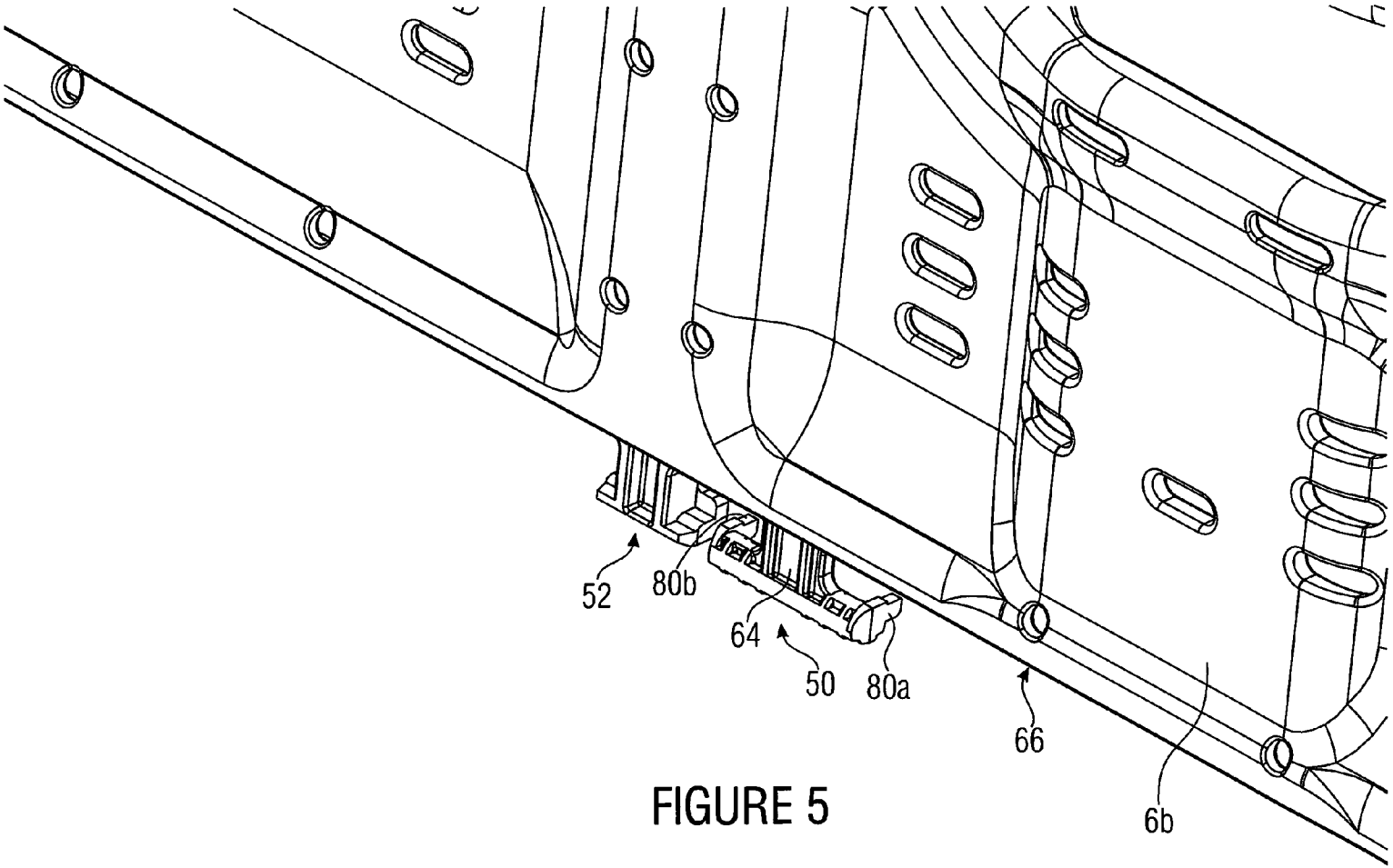
FIG. 5 is a detailed view of a cam and a shaft of a hinge arrangement used in some embodiments of the invention.
Figure 6:
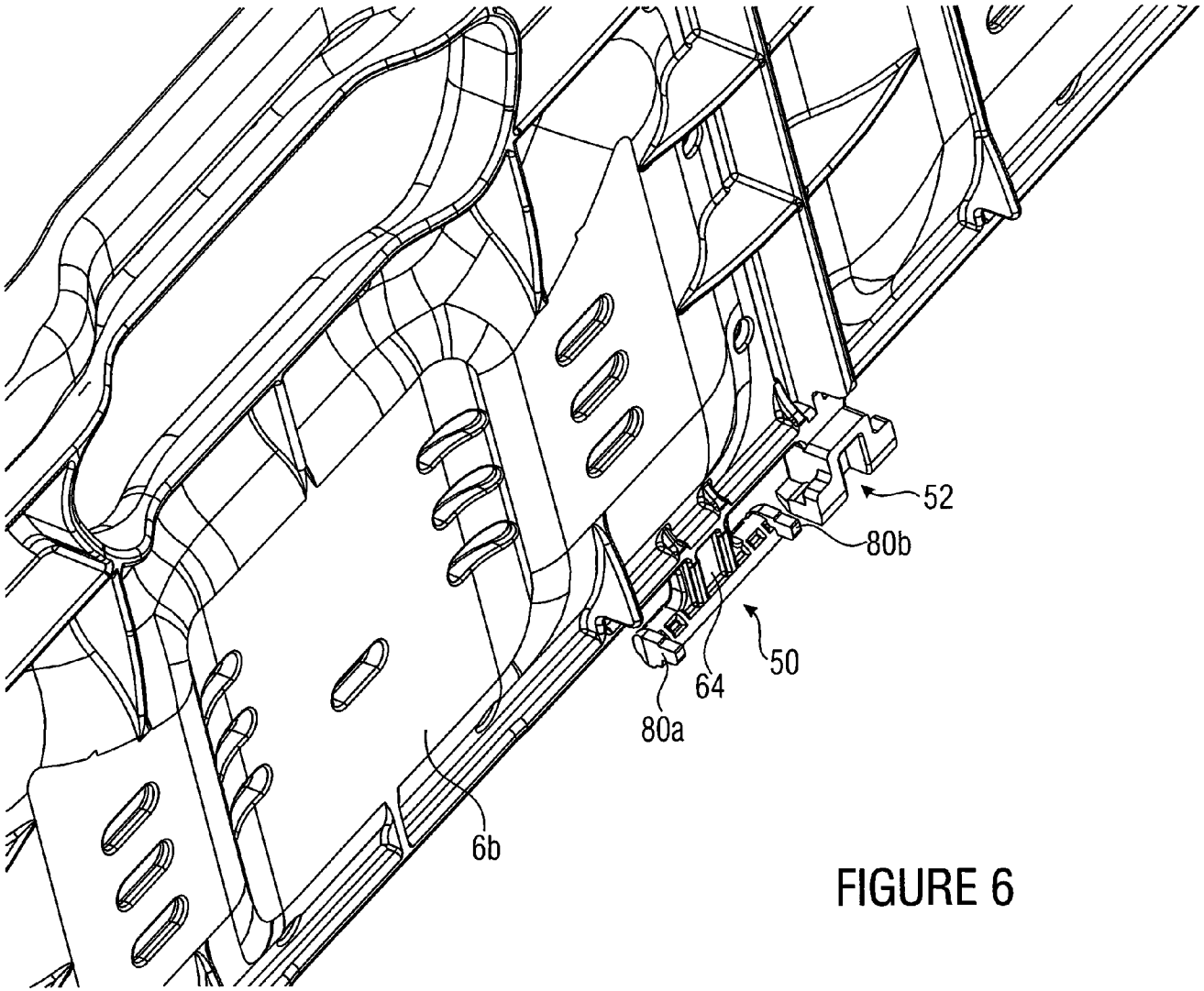
FIG. 6 is a further detailed view of the cam and the shaft of FIG. 5 from a different perspective.

FIGS. 5 and 6 show enlarged sections of a shaft 50 arranged in the base area of the exterior wall 6*b* and a cam 52 arranged in the base area of the hinge arrangement 40*c* of the foldable box 1 from different perspectives, wherein FIG. 5 is a interior view, i.e. in the lateral direction from inside to outside, and FIG. 6 is a view corresponding to the same from outside to inside. The shaft 50 in this embodiment is basically cylindrical and extends in the horizontal direction. The cross-section of the shaft may be of any other form but circular, like for example oval, square, cuboid or triangular. The cam is basically cuboid, wherein the cam contour in some places deviates from the cubic form to achieve the different functionalities of the cam.

Figure 7A:
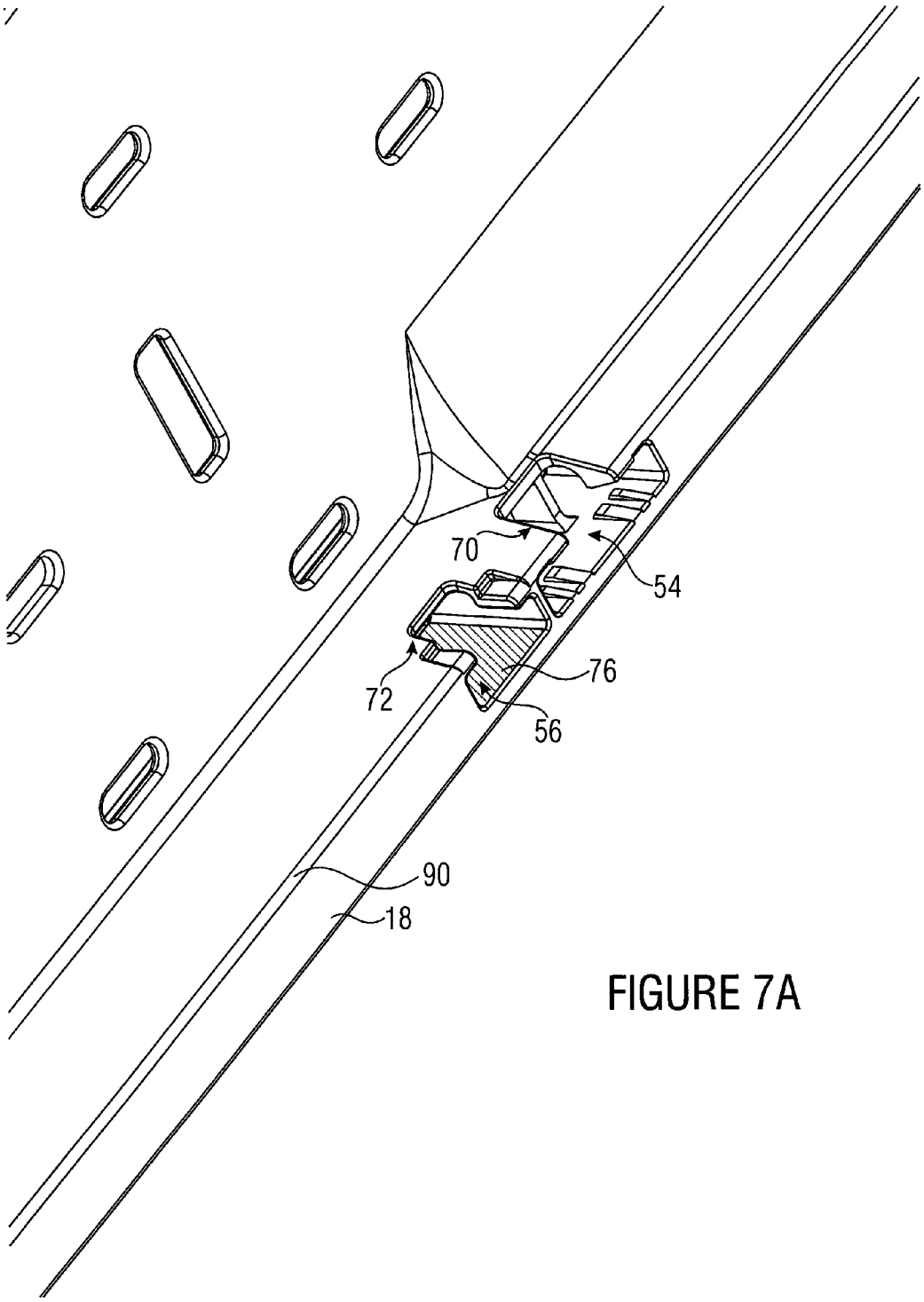
FIG. 7A is a detailed view of a guide opening and a cam opening for receiving the shaft and the cam of FIGS. 5 and 6.
Figure 7B:
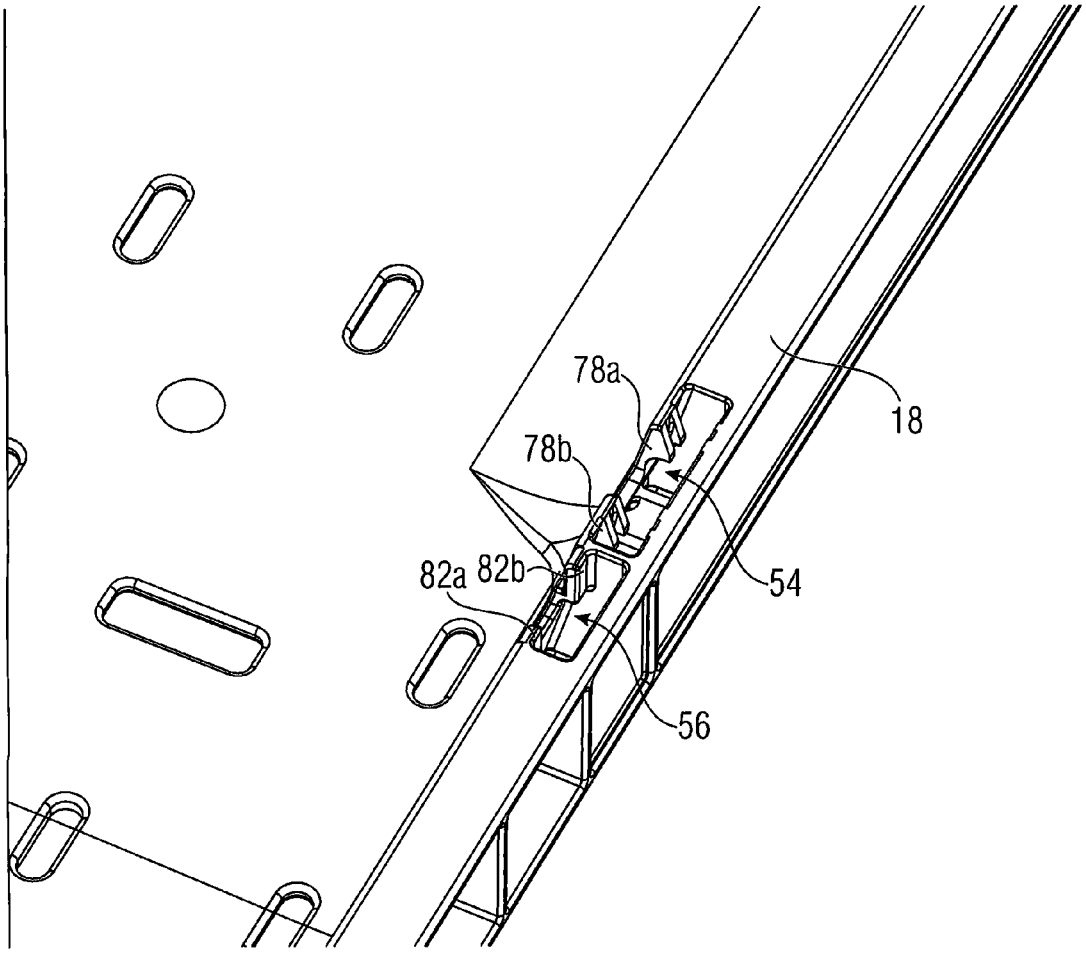
FIG. 7B is a detailed view of FIG. 7A from a different perspective.
Figure 8:
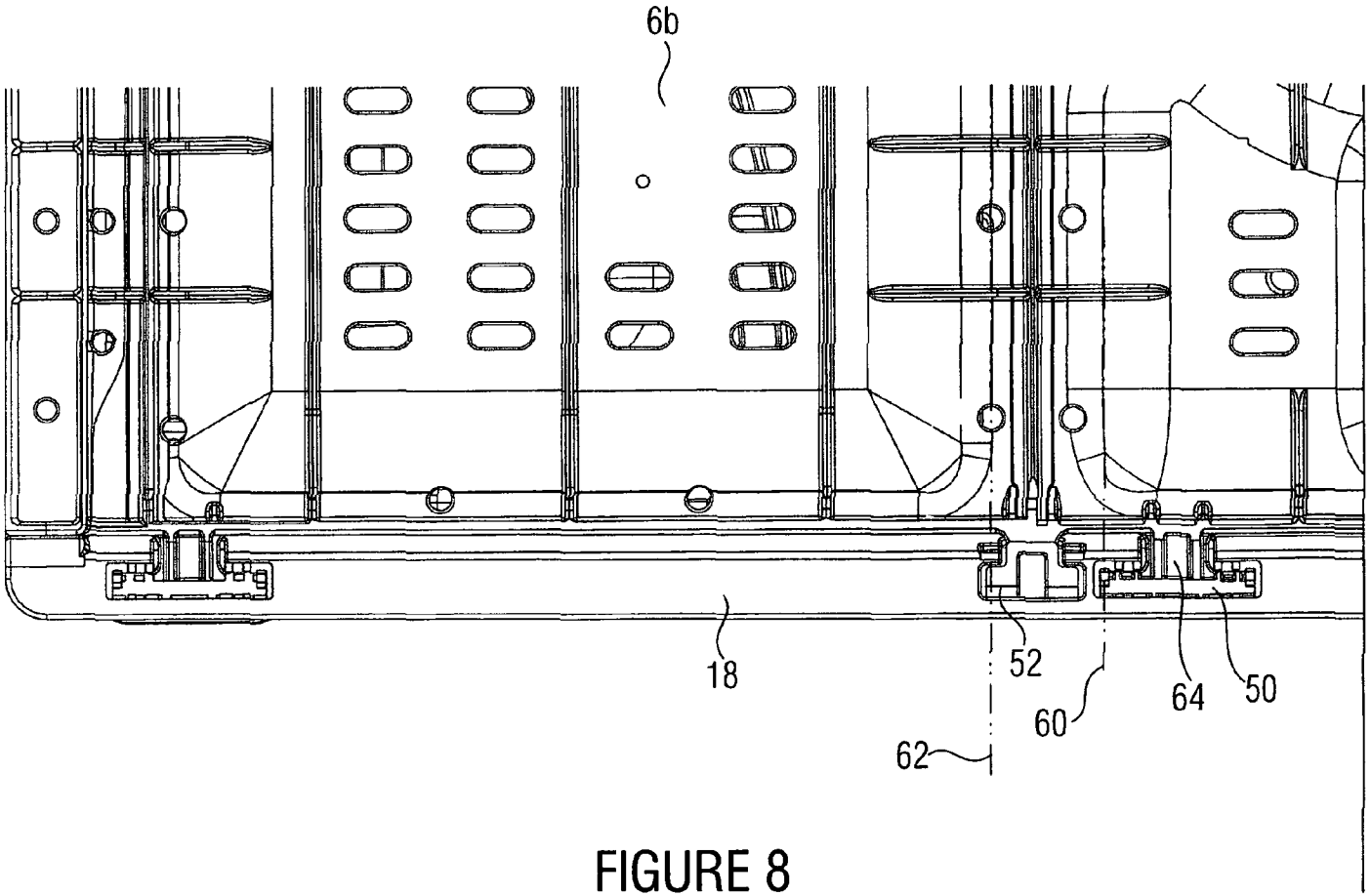
FIG. 8 is a top view onto an embodiment of a hinge arrangement.
Figure 9A:
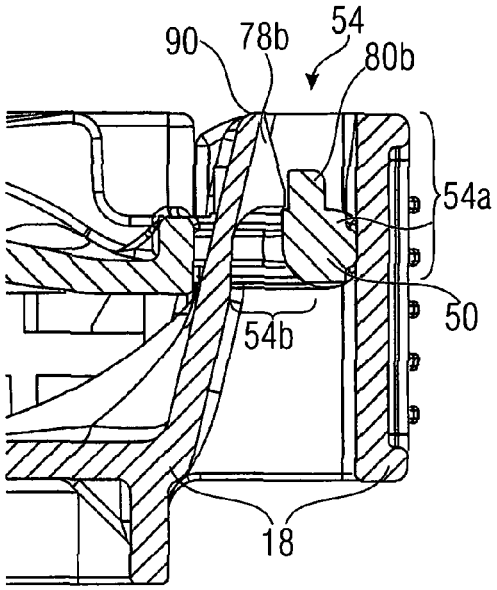
FIG. 9A is a sectional view through the shaft in a down-folded state of the foldable box.
Figure 9B:
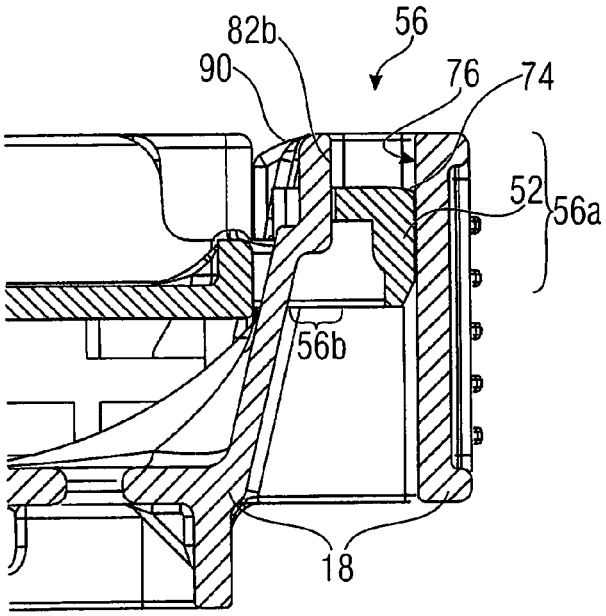
FIG. 9B is a sectional view through the cam in the down-folded state.
Figure 10A:
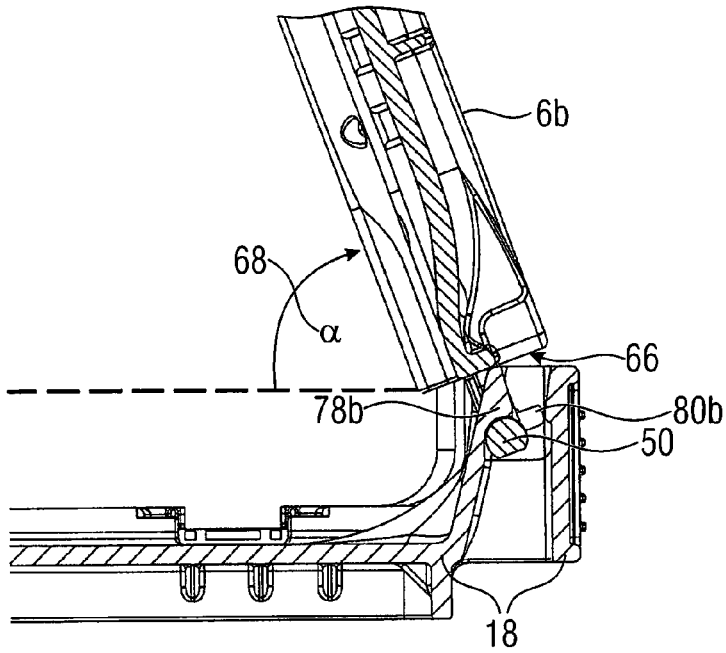
FIG. 10A is a sectional view through the shaft in a half open state.
Figure 10B:
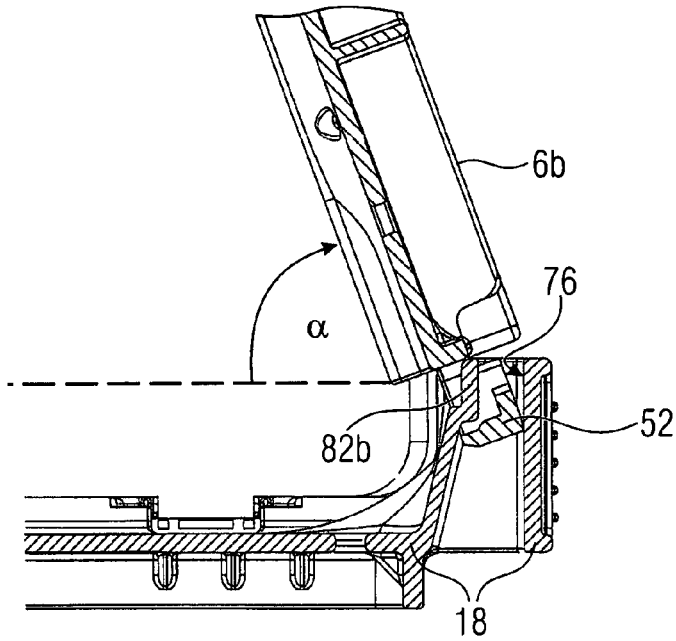
FIG. 10B is a sectional view through the cam in the half open state.
Figure 11A:
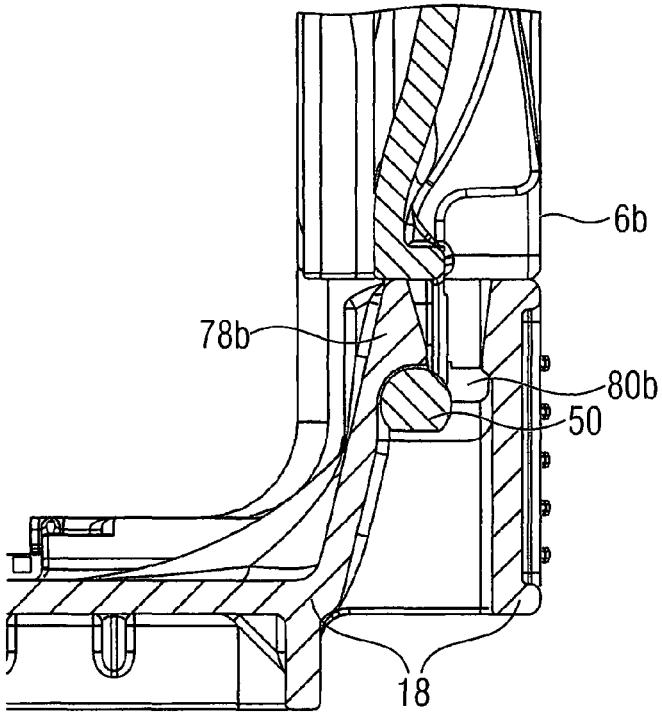
FIG. 11A is a sectional view through the shaft in the opened state.
Figure 11B:
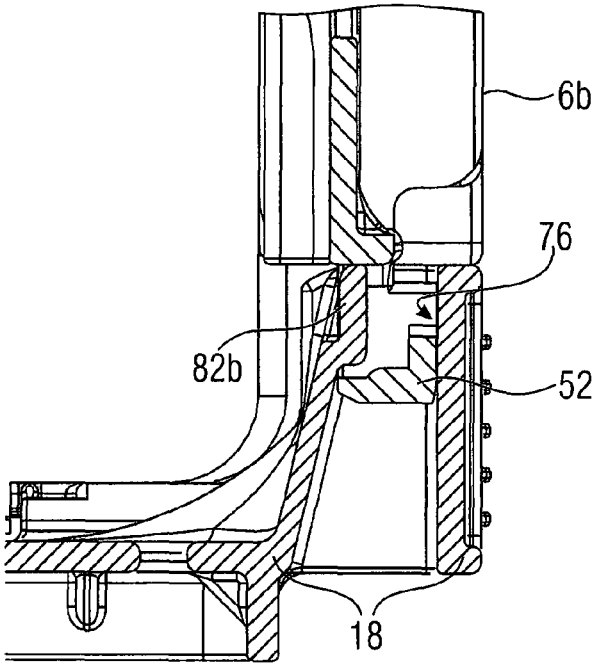
FIG. 11B is a sectional view through the cam in the opened state.

FIGS. 7A and 7B correspond to FIGS. 5 and 6, wherein the same also show a guide opening 54 and a cam opening 56 from different perspectives which are located within the fixed exterior wall area 18 of the floor 2 and in which the shaft 50 and the cam 52 are arranged. FIG. 7A here shows a view from inside to outside, while FIG. 7B shows a view from outside to inside. While FIGS. 5 to 7B show the features of the hinge arrangement in a dismantled state, FIGS. 8 to 11B show the hinge arrangement in the assembled state in which the cam 52 is located within the cam opening 54 and the shaft 50 within the guide opening 54, so that with respect to FIGS. 8 to 11B the interplay or cooperation of the different components of the hinge arrangement may be gathered. Here, FIG. 8 shows a top view onto the hinge arrangement in the down-folded state of the exterior wall 6*b*, while FIGS. 9A to 11B show a sectional view through the hinge arrangement illustrated during different phases of up-folding the exterior wall 6*b*. FIGS. 9A, 10A and 11A each show a section at the sectional line 60 through the shaft 50. FIGS. 9B, 10B and 11B show a section through the cam 52 along the sectional line 62 of FIG. 8. The functioning of the hinge arrangement is described in the following with reference to FIGS. 5 to 11B.

As it may be gathered from FIG. 8, in the embodiment of the invention described here the shaft 50 is arranged in the guide opening 54 and the cam 52 is arranged in the cam opening 56. The guide opening 54 is divided into two functionally different areas, i.e. in an opening portion or section 54*a* extending basically in the vertical direction 8 and a lateral opening section 54*b* extending basically in a lateral direction 12 from the exterior side of the fixed exterior wall area 18 or the guide opening 54 inwards. In the embodiment illustrated here, the lateral opening section 54*b* is located at the floor of the guide opening 54, although this is not to be regarded as a restriction. Rather, in further embodiments of the invention the lateral opening section may also be arranged further up in the vertical direction.

Likewise, the cam opening 56 comprises an opening section 56*a* extending basically in the vertical direction. The cam opening 56 also comprises a lateral opening section 56*b* extending in the lateral direction from the outside or from the exterior side border or restriction of the cam opening 56 inwards. The different opening sections may be identified best in the sectional view of FIGS. 9A and 9B, where they are also provided with corresponding reference numerals. In order not to impair the clarity of illustration of the functioning, in the remaining figures the opening sections were not provided with the respective reference numerals. The opening section 54*a* of the guide opening 54 passing in the vertical direction comprises a cross-section which is large enough to be able to remove the shaft 50 in the down-folded state of the side wall 6*b* in a vertical direction upwards from the guide opening 54. As it is illustrated in the figures, the shaft 50 is connected to the base 66 via a spacer 64, i.e. is rigidly connected to the lower end of the exterior wall 6*b* in the vertical direction 8. When up-folding the wall illustrated in FIGS. 9A to 11B in the direction of an increasing opening angle 68 ($\alpha$), the shaft 50 is rotated relative to the guide opening 54. In the same way, the cam 52 permanently fixed to the base 66 of the exterior wall 6*b* is rotated relative to the cam opening 56. In the embodiment of the present invention described with reference to FIGS. 7A to 11B, also the opening area 56*a* of the cam opening 56 basically passing in the vertical direction comprises a cross-section which is large enough so that the cam 52 in the down-folded state may be guided out vertically upwards from the cam opening 56. As it may be gathered from the half top view of the exterior wall 6*b* in FIG. 8, the side wall 6*b* is connected to the fixed exterior wall area 18 via four shafts and two cams of the above described type.

In the down-folded state, the exterior wall 6*b* may easily be dismantled without any tools which facilitates exchanging a possibly damaged exterior wall. For down-folding the exterior wall, both the guide opening 54 and also the cam opening each comprise an interior side breakthrough or perforation 70 or 72 in the interior or internal boundary wall of the openings 54 and 56, in which the spacer 64 of the shaft or the part of the cam 52 serving for mounting a cam 52 to the base 66 of the side wall 6*b* may be moved.

In contrast to conventional hinge mechanism, thus the connection between side wall and fixed exterior wall area in the down-folded state may be undone without any tools, i.e. a force acting in the down-folded state in the vertical direction onto the exterior wall 6*b* is not absorbed by the hinge arrangement or transferred to the floor 2, as it is needed in order to be able to load the box in the up-folded state.

The traction or adhesion in the inventive embodiment is only produced when erecting the exterior wall 6*b*, in which respect the cam 52 and the shaft 50 cooperate as follows. In the down-folded state illustrated in FIGS. 9A and 9B, the shaft 60 is located within the vertically passing opening section 54*a* of the guide opening 54 and the cam 52 is also located within the vertically passing opening section 56*a* of the cam opening 56. In the embodiment illustrated here, both the shaft 50 and also the cam 52 are applied or contact the exterior side wall of the respective guide opening and no forces act upon the shaft 50 or the cam 52.

The contour of the cam 52 in the embodiment illustrated here is not basically radial like the contour of the shaft, but L-shaped with an edge 74 applied to or contacting the exterior side of the CAM opening 56. The exterior wall or exterior side 76 of the cam opening 56, when erecting or raising the exterior wall 6*b* acts as a contact surface at the fixed exterior wall area 18 where the cam 52, when erecting the exterior wall 60, so to speak, is supported. By the L-shaped contour of the cam with the edge 74, thus directly after starting erecting a force directed inwards acts upon the side wall 6*b* which leads to the shaft 50 in the lateral opening section 54*b* to be moved inwards, so that already when exceeding a predetermined threshold angle or boundary angle, the same is located within the lateral opening section 54*b* (at an interior side end position in the lateral opening section 54*b*), as it is illustrated in FIG. 10A. The lateral opening section 54*b*, as it may for example be gathered from FIG. 7, is bounded vertically upwards by the material of the fixed exterior wall area 18. This limitation is formed in FIG. 7 by the two lugs 78*a* and 78*b*, extending above the lateral opening section 54*a* into the gate opening 54 and preventing the possibility of moving the shaft out of the guide opening 54. Due to the cam 52 and the contact surface 76 of the cam, when erecting the shaft 50 is moved laterally inward within the lateral opening section 54*b* up to a position in which the shaft 50 may not be removed from the guide opening toward the top, so that the shaft may transmit a force to the floor 2 acting in a vertical direction upward onto the exterior wall 6*b*.

Generally speaking, thus the cam 52 comprises a cam contour which is implemented such that the cam contour, when erecting the exterior wall, gets into contact with a contact surface 56 such that the shaft 50 is moved inwards in the lateral opening section 54*b*. The shape of the contact surface is not important here, the plane contact surface illustrated in the figures is only to be regarded as an example for any geometry of the contact surface, which leads to a force being exhibited onto the cam. For example, the contact surface may also be inclined with respect to the vertical direction 8, which, in combination with a basically circular cam contour with respect to the contact surface 56 also leads to the fact that during aligning the shaft is moved inwards. This embodiment also makes clear that the geometry of the cam may virtually be random, as long as the cam contour is implemented such that the cam contour gets in contact with the contact surface such that the shaft 50 is moved inwards.

In the completely upfolded state illustrated in FIG. 11A, thus the shaft 50 is located in the lateral opening section 54*b* of the guide opening 54, so that now the exterior wall 6*b* and the floor are connected to each other in a non-positive way. The embodiment illustrated here additionally comprises two protrusions 80*a* and 80*b* which extend in a lateral direction up to the exterior side edge of the guide opening 54 in the upfolded state of the exterior wall 6*b*. These optional protrusions 80*a* and 80*b* additionally prevent a shaft 50 to be displaced from its position unwantedly, for example, by elastic deformation, when the exterior wall 6*b* is in the upfolded state.

The embodiment illustrated here further comprises a further optional implementation or functionality of the cam 52. In the case illustrated here, the cam contour is L-shaped at the position in which the lateral opening section 56*b* of the cam opening 56 is limited upwards by material of the fixed exterior wall area 18 (at the positions of the overhangs 82*a* and 82*b*), so that, as it may be gathered from FIGS. 10B and 11B, the cam engages into the lateral opening section 56*b* of the cam opening. By this, in the erected state a force is transmitted from the exterior wall 6*b* to the floor 2 by the cam 52 which may additionally increase the stability of the overall construction when this optional feature is implemented.

As described above, also by the functional cooperation of a cam 52 with a contact surface 76 and a shaft 50 arranged in a guide opening 54, according to the invention, a hinge arrangement may be provided which may be dismantled in the down-folded state and is able in the upfolded state of the exterior wall 6*b* to transfer the needed forces to the floor 2.

A further embodiment of the present invention is also discussed in the following with reference to FIGS. 6 to 11B. This embodiment enables to connect an exterior wall by means of a hinge arrangement to the floor 2 of a foldable box 1 such that the exterior wall 6*b* is held by itself in the erect position after erecting. As it is not of primary importance regarding this embodiment that the guide opening 54 and the cam opening 56 in the vertical direction are implemented such that cams 52 and shaft 50 may be removed from the top, this feature is optional in the embodiments of the present invention described now. In the embodiments of the present invention enabling a wall standing on its own, it is needed for the cam contour of the cam 52 to be implemented such, as illustrated in FIG. 10A, that the cam contour when erecting the exterior wall 6*b* gets into contact with the guide surface 76 such that when exceeding a threshold angle 68 the shaft 50 is moved inwards before the underside or the base 66 of the exterior wall 6*b* getting into contact with the interior edge area 19 or the interior edge 90 of the fixed exterior wall area 18.

Then, the shaft 50 may already before that absorb a force acting in the vertical direction so that it is possible to dimension the distance of the interior edge area 90 to the shaft 50 such that when moving the exterior wall 6*b* over the edge 90, i.e. when exceeding the boundary angle 68 by the effect of the shaft 50 the underside 66 of the exterior wall 6*b* is pressed against the interior edge area 90 with a contact pressing force which is larger than a second contact pressing force using which the underside 66 of the exterior wall 6*b* is pressed, in the upright vertical position, against the upper side of the fixed exterior wall area 18 by the effect of the shaft 50. In an alternative embodiment which is not illustrated, the interior side of the cam contour may be implemented such that when exceeding the edge 90, the contact pressing force is achieved by the effect of the cam 52, when the same is for example already in contact with the material 82*b* of the cam opening 56 limiting the cam opening 56 toward the top.

Generally speaking, the upfolded wall is held in the upfolded state when the cam contour is implemented such that the cam contour, when erecting the exterior wall 6*b* gets into contact with the guide surface 76 such that when exceeding a boundary angle or threshold angle 68 the shaft 50 is moved inwards into the natural opening section 54*b*, so that after exceeding the boundary angle 68 by the effect of the shaft 50 or the cam 52 an underside 66 of the exterior wall 6*b* is pressed with a first contact pressing force against an interior edge area 90 of the fixed exterior wall area 18. This first contact pressing force is higher than a second contact pressing force using which the underside 66 of the exterior wall 6*b*, in the upright position, is pressed into the upper side of the fixed exterior wall area 18 by the effect of the shaft 50 or the cam 52.

The exterior wall area whose resistance has to be overcome when upfolding, does not have to be formed by the complete length of the interior edge 90 of the fixed exterior wall area 18. It is rather also possible, for example in order to influence the needed force, to bring only geometrically delimited areas of the interior edge 90 in contact with the exterior wall 6*b* during opening. In this respect, for example at the internal edge 90 of the external wall, protrusions extending inward may be formed so that the exterior wall 6*b* only has to overcome the resistance caused by these protrusions. This may, for example, serve to set the force needed when erecting the exterior wall 6*b* and to thus adapt the same to the requirements of the user.

In some embodiments, the center of the shaft 50 in the lateral direction 12 after moving the shaft 50 inward is further in the direction of the exterior side of the foldable box 1 than the interior edge 90 which causes the distance between the internal edge 90 and the shaft 50 to be greater than the distance between the top side of the fixed exterior wall area 18 and the shaft 50. This automatically causes the force ratios described above. As with all embodiments of the invention the exterior wall 6*b* is held upright by elastic deformation of the material and not by friction in the form of a retarded shaft or the like, as is conventionally the case, by the inventive embodiments mechanics may be provided which causes, without wear, the upfolded exterior walls 6*b* to remain in the upfolded state by themselves.

Figure 12:
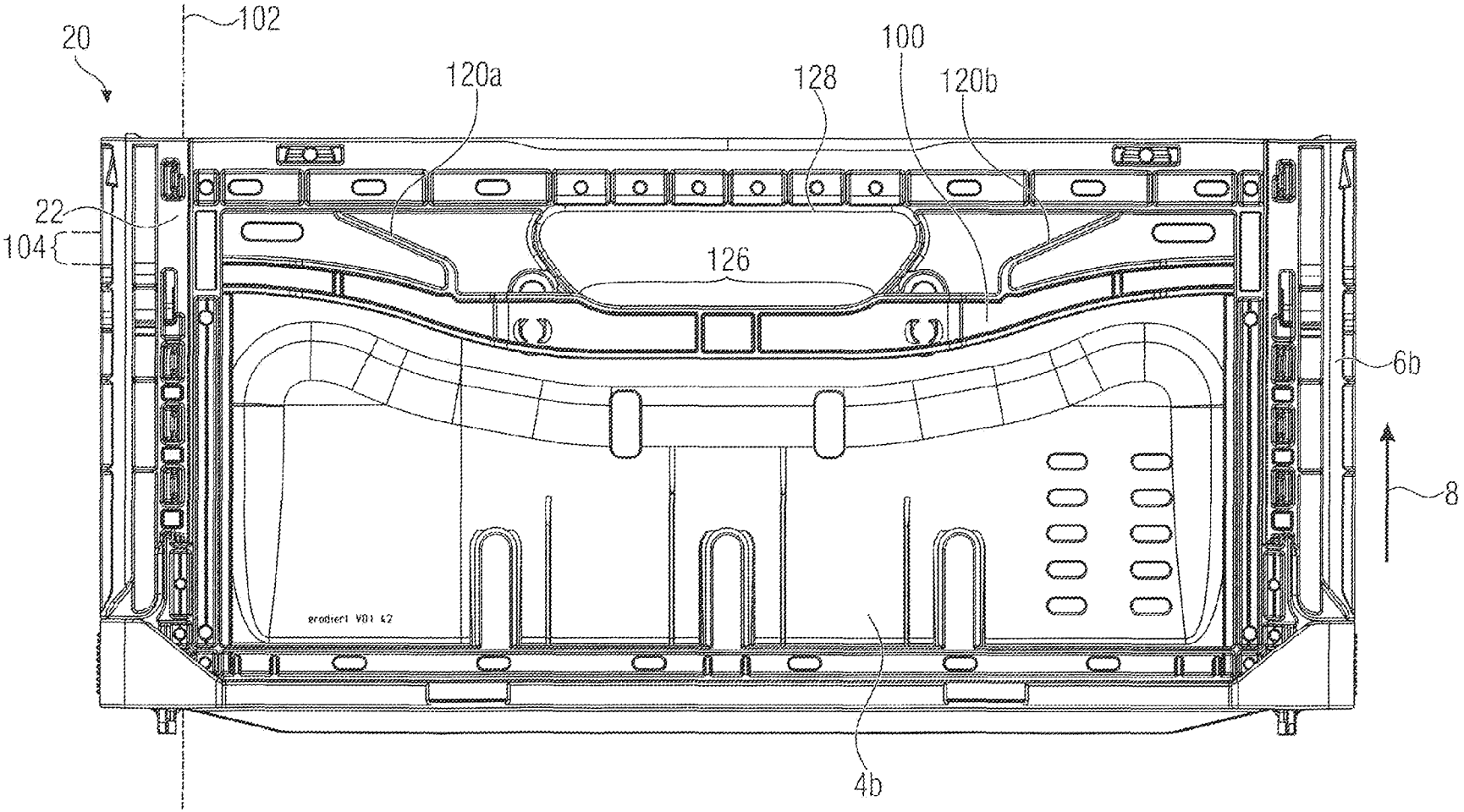
FIG. 12 is a side view of a transverse side wall of an embodiment of a foldable box having a locking mechanism with a snap-in element.
Figure 13A:
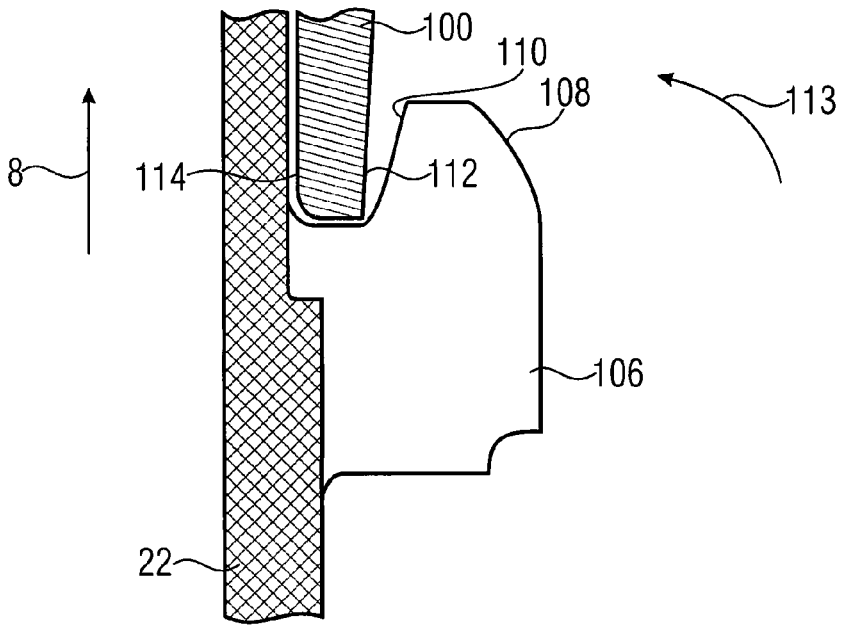
FIG. 13A is an embodiment of a snap-in element.
Figure 13B:
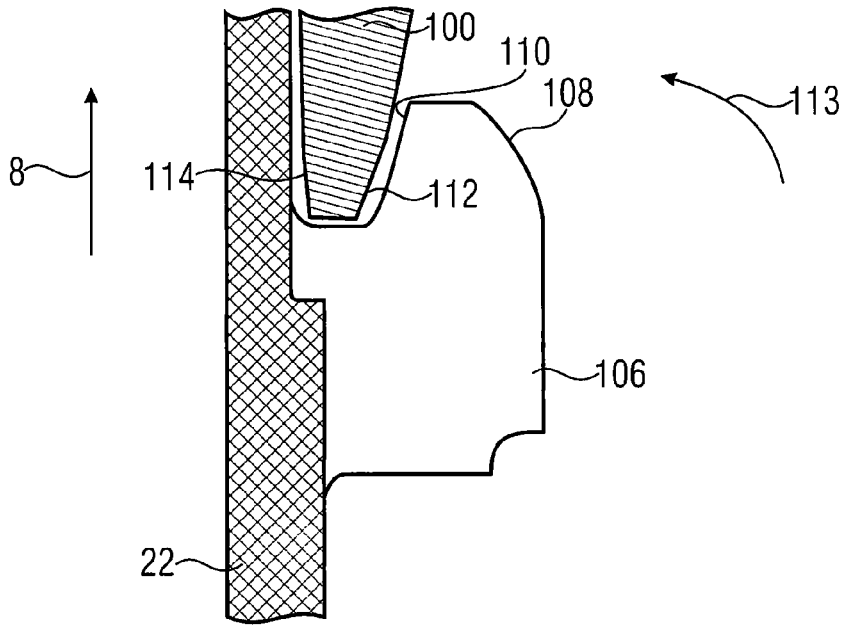
FIG. 13B is a further embodiment of a snap-in element.

With respect to FIGS. 12 and 13A or 13B a further embodiment of the present invention is described, comprising a locking mechanism 100 which on the one hand may be operated in a very force saving or efficient way or is very smooth running and robust and on the other hand additionally comprises an emergency unlocking functionality which guarantees that when the locking mechanism is wrongly operated, it is not damaged, but opens automatically. FIG. 12 shows a side view of the foldable box illustrated in FIG. 1. The transverse side exterior wall 4*b* illustrated in the top view here comprises a spring preloaded or pretensioned locking mechanism 100 having a snap-in element 100 which may latch with the exterior walls 6*a* and 6*b* or with protrusions 22 extending from the longitudinal side exterior walls 6*a* and 6*b* in the direction of the transverse side exterior wall 4*b*. By this, the snap-in element may be connected mechanically detachable with the protrusions so that the longitudinal side sidewalls 6*a* and 6*b* and the transverse side sidewall 4*b* are connected mechanically rigidly, but detachably to each other in order to acquire a stable upfolded box 1.

In the following, a snap-in element is to be discussed with reference to the corner 20 illustrated in FIG. 12 at which the transverse side sidewall 4*b* latches up with the longitudinal side sidewall 6*b*. FIGS. 13A and 13B here show a sectional view along the sectional line 102 of FIG. 12, wherein in FIGS. 13A and 13B only the area 104 in which the snap-in element interlocks or latches with the protrusion 22 is illustrated in an enlarged way. FIGS. 13A and 13B here exemplarily show one of several possible implementations of the snap-in element 100 or the protrusion 22. With already upfolded longitudinal side sidewalls 6*a* and 6*b*, the protrusion 22 extends in the direction of a transverse side exterior wall 4*b*. When upfolding, this causes the protrusion 22 to delimit the foldability of the transverse side exterior wall 4*b* outwards and to, so to speak, act as a stop for the same. When upfolding, the transverse side exterior wall 4*b* will contact the protrusion 22 in the upfolded position. Simultaneously, the snap-in element 100 snaps in at the protrusion of the exterior wall 6*b* in order to acquire a mechanically detachable rigid connection between the longitudinal side and the transverse side exterior walls.

In the embodiment illustrated here, the protrusion 22 comprises a locking hook 106 extending inwards which is basically parallel to the longitudinal side exterior wall 6*a*, wherein the hook includes a first contact surface 108 directed inwards and a second contact surface 110 directed outwards. When upfolding the transverse side exterior wall 104 in the upfolding direction 113, the longitudinal side exterior wall 6*b* and with the same the protrusion 22 and the locking hook 106 attached to the protrusion 22 are in a fixed position. When upfolding, together with the transverse side exterior wall 4*b*, the snap-in element 100 connected to the transverse side exterior wall is moved relative to the locking hook 106 in the upfolding direction 113 illustrated in FIG. 13A. Here, the snap-in element 100 further comprising a first contact surface 112 directed inward and a second contact surface 114 directed outward, gets into contact with the contact surface 108 of the locking hook 106 directed inward. Due to the inclination of the contact surface 108 of the locking hook 106 directed inward, the snap-in element or locking element 100 is moved upward in the vertical direction 8 and may snap into a locking position in the locking hook 106 illustrated in FIGS. 13A and 13B.

The snap-in element 100 and the spring preloaded locking mechanism are implemented integrally in the embodiment described here and thus provided with the same reference numerals. Also, the spring preload or pretension in the embodiment of the invention discussed here is achieved by spring elements 120*a* and 120*b* formed integrally with the locking mechanism, wherein the spring elements exert the spring force onto the locking mechanism 100 due to their elasticity and shaping. If the snap-in element 100 is in the locked position in the locking tap 106, the longitudinal side sidewalls 6*a* and 6*b* and the transverse side sidewall 4*b* are mechanically latched or interlocked and connected so that the box has a high stability. The locking may here be released in a simple way by actuating the locking mechanism 100 in the vertical direction upwards which may be executed in a simple way and even at the same time when lifting the box due to the shape of the locking mechanism having a grip area 106 arranged below the carrying opening 128.

As locking and unlocking is executed in the vertical direction 8 and in this direction no force has to be absorbed by the connection between the longitudinal side exterior walls 6*a*, 6*b* and the transverse side exterior wall 4*b*, for locking and unlocking no large force has to be used and the mechanism may be operated easily and reliably. According to the embodiments of the present invention, also the second contact surface 110 of the locking hook 106 directed outward is inclined with respect to the vertical direction 8 and/or the first contact surface 112 of the locking or snap-in element 100 directed inward is inclined. Here, in the embodiments of the present invention, the average inclination of the first contact surface 108 of the locking hook directed inward is larger than the average inclination of the second contact surface 110 of the locking hook 106. As also the first contact surface 110 of the locking hook 106 directed outward is inclined relative to the second contact surface 112 of the snap-in element 100 directed inward, a force component acts upward upon the snap-in element 100 even if a force is exerted on the transverse side exterior wall 4*b* from the outside.

By this, the spring preloaded locking mechanism automatically opens without being destroyed when a predetermined force is exceeded. This force may be set randomly by adapting the relative inclination between the second contact surface 110 of the locking hook 106 directed outward and the first contact surface 112 of the snap-in element 110 directed inward, considering the spring pretension. By this, in the described embodiments of the present invention, it is prevented that the locking mechanism is destroyed when an operating error occurs, although the same is implemented so that it locks perpendicular to the direction of movement.

Although in the embodiment described in FIGS. 13A and 13B at the protrusion 22 an additional locking hook 106 is attached, alternative embodiments of the present invention may also directly interlock with the protrusion 22 or a suitable opening in the protrusion 22 itself. What is decisive here is that the protrusion 22 or an element connected with the same and/or the snap-in element 100 in the upfolded state comprise contact surfaces 110 and 120 inclined such with respect to the vertical direction 8 that the locking mechanism 100 opens against its spring pretension when exceeding a predetermined force directed inward to the transverse side exterior wall 4*b*.

Although each spring preloaded locking mechanism 100 and the snap-in element in the embodiment described in FIG. 12 are implemented integrally, it is of course also possible to implement these components in several pieces or for example to implement the locking mechanism separately for each side. Also in these cases the destruction-free emergency unlocking function may be maintained.

Any of the above embodiments were described with respect to foldable boxes used here for the transport of vegetables or the like. Of course, foldable boxes according to the invention are not restricted to this field of application. Rather, there is also the possibility to execute different transport tasks, like the transport of bottles or the like using similar foldable boxes, wherein in particular the contour of the floor-shape or the internal exterior walls may be changed to be adapted better to the specific task.

Also with reference to the selected materials any combinations are possible. Thus, for manufacturing inventive foldable boxes, for example plastics, metal or wood may be used. Due to the especially robust implementation, here also heavy loads may be transported securely and reliably, as it is for example the case in catering when transporting dishes or cutlery or the like. As the use of one of the above-described embodiments leads to foldable boxes which are hygienic, easy to clean, very robust, compactly foldable and extremely simple and efficient in handling, there are no limitations regarding the field of application of inventive foldable boxes, as the same are suitable for virtually any use due to the plurality of positive characteristics.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A foldable box comprising;

four foldable exterior walls, wherein at least one of the exterior walls comprises:

at least a first wall area and a second wall area, the first and second wall areas being convex with respect to an exterior side of the box and adjacent to each other in a horizontal direction;

a bridge arranged between the first and the second wall areas extending across the height of the exterior wall and arranged at the exterior side of the exterior wall;

at least one rib extending from the bridge to the first wall area and to the second wall area; and one or more further bridges extending across the first and second wall areas.

2. The foldable box according to claim 1, comprising a plurality of ribs, extending from the bridge up to the first and second wall areas.

3. The foldable box according to claim 1, wherein the at least one rib is arranged basically perpendicular to the bridge.

4. The foldable box according to claim 1, further comprising:

a hinge mechanism by means of which the at least one exterior wall is foldably connected to a floor of the box, wherein the hinge mechanism is basically arranged at the position at a base area of the exterior wall where the bridge extends up to the base area of the exterior wall.

5. The foldable box according to claim 1, wherein the at least one exterior wall comprises a plurality of bridges, wherein to each of the first and second wall areas in a horizontal direction at each side at least one bridge is connected extending across the height of the exterior wall and arranged at the outside of the exterior wall; and wherein one rib is associated with each of the bridges extending from the bridge to each of the first and second wall adjacent to the bridge in the horizontal direction.

6. The foldable box according to claim 5, further comprising:

a plurality of hinge mechanisms by means of which the at least one exterior wall is foldably connected to the floor of the box, wherein each of the hinge mechanisms is arranged in the horizontal direction at a position in the base area of the exterior wall, at which one of the bridges extends up to the base area of the exterior wall.

7. The foldable box according to claim 1, wherein the first and/or the second wall areas is provided with a plurality of holes.

8. The foldable box according to claim 7, wherein the plurality of holes is arranged in a plane partial surface of the first and/or the second wall areas.

* * * * *